United States Patent [19]

Okazaki

[11] Patent Number: 4,534,120

[45] Date of Patent: Aug. 13, 1985

[54] DRYER FOR A CONTINUOUS TEXTILE FABRIC

[75] Inventor: Narukazu Okazaki, Wakayama, Japan

[73] Assignee: Wakayama Iron Works, Ltd., Wakayama, Japan

[21] Appl. No.: 547,872

[22] Filed: Nov. 2, 1983

[51] Int. Cl.[3] ..... F26B 13/18

[52] U.S. Cl. ..... 34/119; 34/124; 34/159; 34/161; 68/5 E

[58] Field of Search ..... 34/41, 119, 124, 152, 34/159, 161, 62, 66; 68/5 D, 5 E

[56] References Cited

U.S. PATENT DOCUMENTS

| | | | |
|---|---|---|---|
| 2,046,553 | 7/1936 | Edwards | 34/119 |
| 2,103,110 | 12/1937 | Dickhaut et al. | 34/159 |
| 3,174,228 | 3/1965 | Smith | 34/41 |
| 3,895,909 | 7/1975 | Greer | 68/5 D |
| 3,896,559 | 7/1975 | Martin | 34/161 |
| 4,081,913 | 4/1978 | Salminen | 34/119 |

FOREIGN PATENT DOCUMENTS 52-12210 3/1977 Japan .

*Primary Examiner*—Larry I. Schwartz
*Assistant Examiner*—David W. Westphal
*Attorney, Agent, or Firm*—Paul & Paul

[57] ABSTRACT

A dryer for uniformly drying a continuous textile fabric comprises a housing for defining a drying chamber, a plurality of guide rolls for the fabric, located in the drying chamber so as to form a zigzag path for moving the fabric, and a plurality of heat-radiating plates. Each plate is located between the sequent guide rolls so as to face the fabric moving path. Each guide roll has a hollow formed therein and connected through a conduit to a water tank located outside of the housing at a level above that of the guide roll.

14 Claims, 2 Drawing Figures

DRYER FOR A CONTINUOUS TEXTILE FABRIC

BACKGROUND OF THE INVENTION

1. Field of the Invention

The present invention relates to a dryer for a continuous textile fabric. More particularly, the present invention relates to a dryer for uniformly and continuously drying a textile material so as to cause the resultant dried fabric to exhibit a good touch.

2. Description of the Prior Art

Japanese Examined Utility Model Publication No. (Kokoku) 52-12210 (1977) discloses a heat-radiating dryer for a textile fabric. The dryer is provided with a plurality of guide rolls for moving a textile fabric along a predetermined path and a plurality of heat-radiating plates for heating the moving fabric. In this dryer, overheating of the guide rolls by the heat-radiating plates is prevented by placing a plurality of heat-shielding plates therebetween. Arrangement of the heat-sheltering plates between the guide rolls and heat-radiating plates, however, complicates the structure of the resultant dryer. Also, this structure of the dryer is not always satisfactory in maintaining the temperature of the guide rolls constant. If the temperature of the guide rolls is not constant, the drying effect on the fabric becomes uneven. Accordingly, it is very important to provide a dryer which is capable of maintaining the temperature of the guide rolls constant.

SUMMARY OF THE INVENTION

An object of the present invention is to provide a dryer for uniformly drying a continous textile fabric in a completely windless state in a superheated water vapor-containing atmosphere at a temperature of 150° C. or more.

Another object of the present invention is to provide a dryer for uniformly drying a textile fabric, while preventing undesirable overheating of the fabric.

The above object can be attained by the dryer of the present invention, which comprises a housing for defining a drying chamber for a continuous textile fabric, having an entrance and an exit for the textile fabric; means for introducing the fabric into the drying chamber through entrance; means for delivering the fabric from the drying chamber through the exit; a plurality of guide rolls for the fabric, arranged in the drying chamber in such a manner that a zigzag path for moving the fabric through the guide rolls is formed; and a plurality of heat-radiating plates, arranged in the drying chamber between the sequent guide rolls and facing the moving path of the fabric, each guide roll having a hollow formed therein and connected through a conduit to a water tank located outside of the housing at a level above the level of the guide roll.

DESCRIPTION OF THE PREFERRED EMBODIMENTS

In the dryer of the present invention, a textile fabric is continuously dried in a completely windless condition in a superheated water vapor-containing atmosphere at an elevated temperature of, for example, 150° C. or more.

Figure 1:
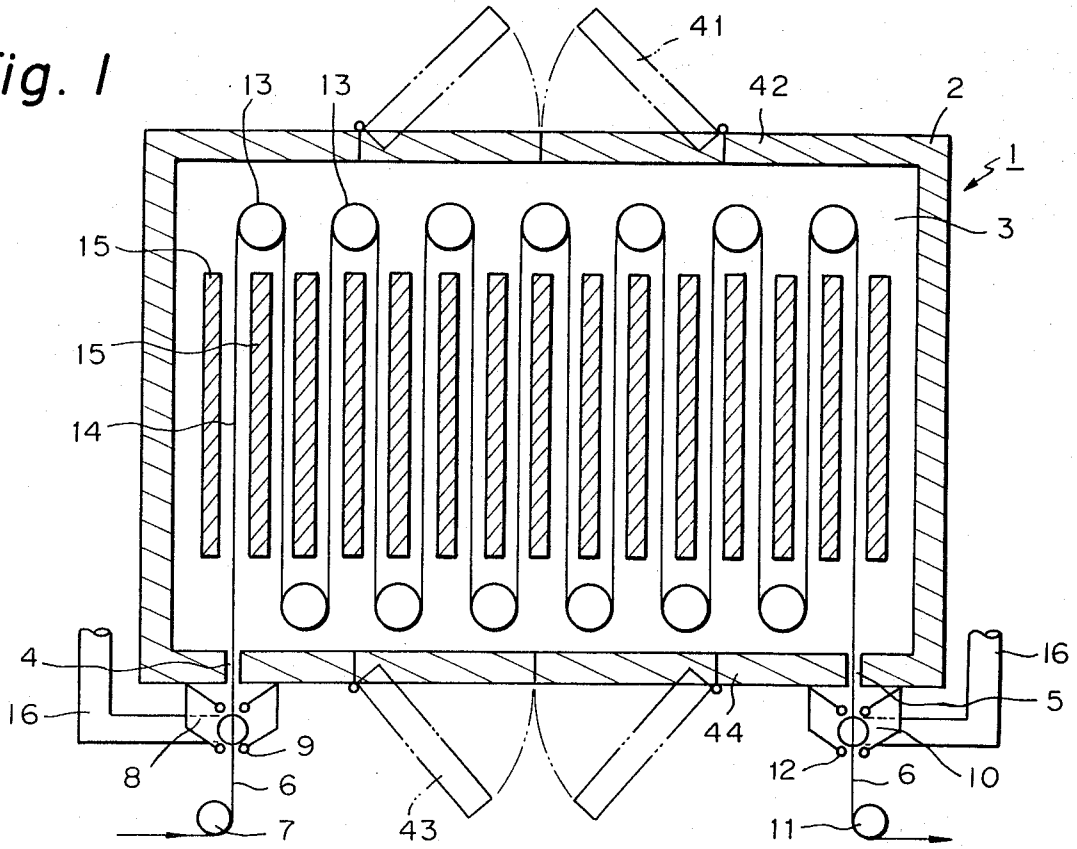
FIG. 1 is a cross-sectional explanatory view of an embodiment of the dryer of the present invention.

Referring to FIG. 1, a dryer 1 of the present invention is provided with a housing 2. The housing 2 defines a drying chamber 3 therein and has an entrance 4 and an exit 5 for a fabric 6. The housing 2 is made of a heat-insulating material.

The fabric 6 is introduced into the drying chamber 3 through a feed roll 7, a sealing box 8, and the entrance 4. The sealing box 8 is provided with at least one pair of heat-radiating pipes 9 straddling the moving path of the fabric 6. The heat-radiating pipes 9 serve to heat the sealing box 8 and to prevent undesirable formation of water drops.

The fabric 6 is delivered from the drying chamber 3 through the exit 5, a sealing box 10, and a delivery roll 11. The sealing box 10 has at least one pair of heat-radiating pipes 12 which serve to maintain the temperature of the sealing box 10 at a desired level high enough to prevent undesirable formation of water drops. The heat-radiating pipes 9 and 12 do not touch the fabric.

Each sealing box 8 or 10 is provided with an exhaust duct 16 through which vaporized water-containing gas is discharged so as to prevent blowing out of the vaporized water-containing gas through the entrance of the box 8 or the exit of box 10.

In the drying chamber 3, a plurality of guide rolls 13 are arranged so as to form a zigzag path 14 of movement of the fabric. Also in the drying chamber 3, a plurality of heat-radiating plates 15 are arranged. The heat-radiating plates 15 are located between the sequent guide rolls 13 and face the fabric-moving path 14. That is, heat-radiating surfaces of adjacent plates 15 are spaced from and face each other through the fabric-moving path, thus evenly heating both the surfaces of the fabric.

The heat-radiating plates can be heated in any conventional manner. For example, the heat-radiating plates may contain heating medium pipe connected to a heating medium supply source. In this case, a heating medium, for example, steam, hot water, or hot oil, is fed from a supply source, at which the heating medium is heated to a desired temperature, to the heat-radiating plates through a heating medium pipe so as to maintain temperature of the heat-radiating plates at a desired level.

The heat-radiating plates may also be heated by an electric heater or an infrared ray heater.

Usually, the heat-radiating plates have a plurality of heat-radiating projections, for example, heat-radiating fins. The heat-radiating projections may have rough surfaces.

The surfaces of the heat-radiating plates may be coated with a heat-resistant resin, for example, polytetrafluoroethylene, and may be colored black.

When the dryer of the present invention is operated, the heat radiated from the heat-radiating plates 15 mainly heat a wet fabric so as to uniformly and gradually dry the wet fabric. In this operation, however, some of the radiated heat heats the guide rolls. This sometimes results in overheating of the guide rolls. Therefore, it is necessary to maintain the temperature of the guide rolls at a desired level.

Figure 2:
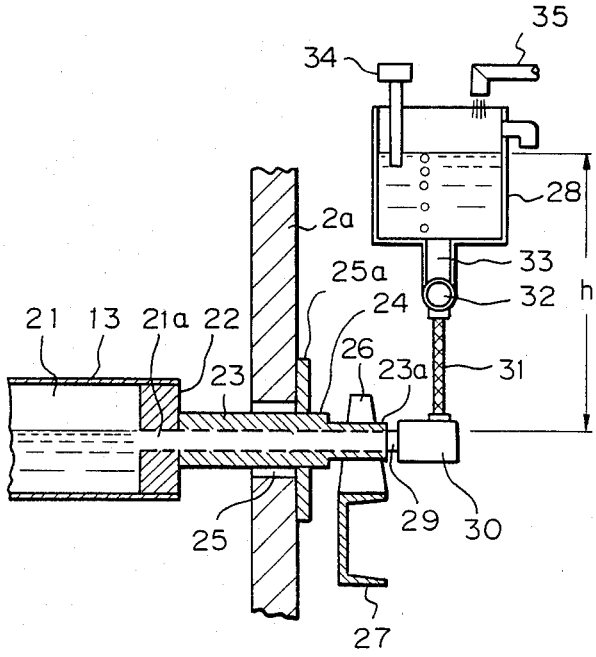
FIG. 2 is a partial cross-sectional explanatory view of a guide roll and a water tank connected to the guide roll.

In view of this, each guide roll in the dryer of the present invention has a hollow formed thereinside connected to a water tank. Referring to FIG. 2, a guide roll 13 has a hollow 21 formed therein. An end portion 22 of the guide roll 13 also has a hollow 21*a* therein and is connected to a rotating shaft 23 having a hollow 24 therein. The hollow 21 is connected to the hollow 24 through the hollow 21*a*.

The rotating shaft 23 passes through a hole 25 formed in a heat-insulating wall 2*a* of the housing 2. The hole 25 is sealed by a sealing plate 25*a*. An end portion 23*a* of the shaft 23 is borne by a bearing 26 supported by frame 27. The end portion 23*a* of the shaft 23 is connected to a water tank 28 through a conduit 29, a rotary joint 30, a branch pipe 31, a distributing pipe 32, and a main pipe 33. That is, water in the water tank 28 flows down into the distributing pipe 32 through the main pipe 33 and is distributed into the a plurality of branch pipes 31. The water in each branch pipe 31 further flows down into the hollow 21 of the guide roll 13 through the rotary joint 30, the conduit 29, and the hollow 24 of the shaft 23.

The boiling temperature of water in the hollow 21 of the guide roll 13 depends on the height h of the level of the water in the water tank 28 from the level of the water in the guide roll hollow 21. For example, when the height h is in the range of from 0.3 m to 4 m, the boiling point of the water is approximately in the range of from 101° C. to 110° C. Usually, the height h is preferably in the range of from 0.3 to 1 m.

When the temperature of the water in the hollow 21 reaches the boiling temperature, a portion of the water is vaporized. The resultant vapor is discharged into the atmosphere through the shaft hollow 24, the conduit 29, the rotary joint 30, the branch pipe 31, the distributing pipe 32, the main pipe 33, and the water tank 28, thus maintaining the temperature of the water in the hollow 21 constant. Therefore, the temperature of the guide roll 13 can be maintained constant.

In order to maintain the height h constant, it is necessary to maintain the level of the water in the water tank 28 constant. For this purpose, the water tank 28 is provided with a level detector 34. When the detector 34 detects that the level of water in the water tank 28 is lower than a desired level, water is supplied into the water tank through a water supply pipe 35 until the level of water in the water tank 28 reaches the desired level.

By using the above-mentioned type of guide rolls and water-supply system, the fabric to be dried can be protected from being overheated.

Referring again to FIG. 1, the housing 2 may be provided with an upper door 41 arranged in the roof 42 thereof and a lower door 43 located in the bottom 44 of the housing 2. When the temperature of the air in the drying chamber 3 exceeds a predetermined level, the upper and lower doors 41 and 43 are opened so as to allow a portion of the air to be discharged from the drying chamber 3 to the outside of the housing 2 and to decrease the temperature of the air in the drying chamber 3 to the predetermined level.

In the dryer of the present invention, the housing may have a heat-reflecting inside surface. The inside surface may have a heat-reflecting coating, consisting of, for example, deposited aluminum film. The heat-reflecting surface is effective for enhancing the heat-efficiency of the dryer.

In the dryer of the present invention, the textile fabric is dried in a superheated water vapor-containing atmosphere while the temperature of the guide rolls is maintained constant. Therefore, the temperature of the fabric is rapidly elevated. However, the heating of the fabric is carried out evenly and the drying of the fabric is effected gradually so that the resultant dried fabric exhibits a uniform appearance and a soft touch.

When the dryer of the present invention is used for drying a textile fabric impregnated with a dye-containing liquid, undesirable migration of the dye-containing liquid from one side to the other side of the fabric can be prevented. Therefore, the dryer of the present invention is useful as a predryer for a continuous dyeing apparatus.

The dryer of the present invention is also useful as a heat-treating apparatus, for example, baking apparatus, for the textile fabric.

Furthermore, the dryer of the present invention is useful as a steamer for treating the textile fabric with steam.

I claim:

1. A dryer for a continuous textile fabric, comprising:

a housing for defining a drying chamber for a continuous textile fabric, having an entrance and an exit for said fabric;

means for introducing said fabric into said drying chamber through said entrance;

means for delivering said fabric from said drying chamber through said exit;

a plurality of guide rolls for said fabric, arranged in said drying chamber in such a manner that a zigzag path for moving said fabric through the guide rolls is formed; and a plurality of heat-radiating plates, arranged in said drying chamber between the sequent guide rolls and facing the moving path of said fabric, each guide roll having a hollow formed thereinside and connected through a conduit to a water tank, said water tank being located outside of said housing at a level above the level of said guide rolls, the water tank being open to the atmosphere outside of said housing, and said hollows, conduit and water tank providing means for preventing said guide rolls from overheating due to said heat-radiating plates.

2. The dryer as claimed in claim 1, wherein said water tank is provided with means for maintaining the level of water contained therein at a predetermined level.

3. The dryer as claimed in claim 1, wherein said predetermined level of water in said water tank is 0.3 to 4 m. higher than the level of water in the guide roll hollow when said water tanks and said guide roll hollow are charged with water.

4. The dryer as claimed in claim 1, wherein said fabric-introducing means is provided with at least one pair of heat-radiating pipes straddling said fabric-moving path.

5. The dryer as claimed in claim 1, wherein said fabric-delivering means is provided with at least one pair of heat-radiating pipes straddling said fabric-moving path.

6. The dryer as claimed in claim 1, wherein said housing is provided with an upper door arranged in a roof thereof and a lower door located in a bottom thereof.

7. The dryer as claimed in claim 1, wherein said housing has a heat-reflecting inside surface.

8. A dryer for a continuous textile fabric, comprising:

a housing for defining a drying chamber for a continuous textile fabric, having an entrance and an exit for said fabric;

means for introducing said fabric into said drying chamber through said entrance;

means for delivering said fabric from said drying chamber through said exit;

a plurality of guide rolls for said fabric, arranged in said drying chamber in such a manner that a zigzag path for moving said fabric through the guide rolls is formed, said guide rolls provided with a hollow therein, a plurality of heat-radiating plates, arranged in said drying chamber between the sequent guide rolls and facing the moving path of said fabric; and means for preventing overheating of said guide rolls by heat from said heat-radiating plates, said overhead prevention means including first means for supplying water to said hollow and for delivering from said hollow water vaporized by said heat.

9. The dryer as claimed in claim 8, wherein said first means further include a water tank and conduit means for coupling said water tank to said hollow of said guide roll.

10. The dryer as claimed in claim 9, wherein said water tank comprises means for maintaining the level of water in said water tank at a predetermined level.

11. The dryer as claimed in claim 10, wherein said predetermined level is higher than the level of water in said hollow of said guide roll.

12. The dryer as claimed in claim 11, wherein said predetermined level is higher than the level of water in said hollow of said guide roll by 0.3 to 4 m.

13. The dryer as claimed in claim 8, wherein said fabric-introducing means is provided with a sealing box comprising heat-radiating pipe means for maintaining the temperature in said sealing box sufficiently high so as to prevent condensation of water vapor in said sealing box.

14. The dryer as claimed in claim 8, wherein said fabric-delivering means is provided with a sealing box comprising heat-radiating pipe means for maintaining the temperature in said sealing box sufficiently high so as to prevent condensation of water vapor in said sealing box.

* * * * *

UNITED STATES PATENT OFFICE

CERTIFICATE OF CORRECTION

Patent No. 4,534,120 Dated August 13, 1985

Inventor(s) Narukazu Okazaki

It is certified that error appears in the above-identified patent and that said Letters Patent are hereby corrected as shown below:

Column 5, lines 10 and 11:

after "said", second occurrence, "overhead" should be --overheat--

Signed and Sealed this

*Twenty-fourth* Day of *December 1985*

[SEAL]

*Attest:*

DONALD J. QUIGG

*Attesting Officer* *Commissioner of Patents and Trademarks*